US006030151A

United States Patent [19]

Woolnough et al.

[11] Patent Number: 6,030,151

[45] Date of Patent: Feb. 29, 2000

[54] METHOD FOR REINFORCING ROCK WITH A TENDON

[75] Inventors: Brian John Woolnough, Toronto; Vincent Martin, Holmesville; Ross James Conn, Rathmines; Murray Joseph Pearson, Toronto, all of Australia

[73] Assignee: Jennmar Corporation, Pittsburgh, Pa.

[21] Appl. No.: 09/043,708

[22] PCT Filed: Jun. 4, 1997

[86] PCT No.: PCT/AU97/00350

§ 371 Date: Mar. 30, 1998

§ 102(e) Date: Mar. 30, 1998

[87] PCT Pub. No.: WO97/46794

PCT Pub. Date: Dec. 11, 1997

[30] Foreign Application Priority Data

Jun. 4, 1996 [AU] Australia ..... PO 0224

[51] Int. Cl.[7] ..... E21D 20/00

[52] U.S. Cl. ..... 405/302.2; 405/259.6

[58] Field of Search ..... 405/259.1, 259.6, 405/302.1, 302.2, 303, 288, 259.5

[56] References Cited

U.S. PATENT DOCUMENTS

| | | | |
|---|---|---|---|
| 3,913,338 | 10/1975 | Galis | 61/63 |
| 4,079,592 | 3/1978 | Eakin | 61/45 |
| 4,226,559 | 10/1980 | Prebensen | 405/303 |
| 4,617,715 | 10/1986 | Koistinen et al. | 29/456 |
| 4,708,533 | 11/1987 | Leppanen | 405/303 |
| 4,710,065 | 12/1987 | Leppanen | 405/303 |
| 4,728,219 | 3/1988 | Leppänen | 405/260 |
| 5,165,825 | 11/1992 | Wallin | 405/303 |
| 5,417,521 | 5/1995 | Scott | 405/259.6 |
| 5,419,660 | 5/1995 | Marquis | 405/259.1 |
| 5,560,740 | 10/1996 | Castle et al. | 405/259.6 |
| 5,931,064 | 8/1999 | Gillespie | 405/259.1 |

FOREIGN PATENT DOCUMENTS

| | | |
|---|---|---|
| 79459/91 | 1/1993 | Australia . |

*Primary Examiner*—William Neuder
*Assistant Examiner*—Frederick Lagman
*Attorney, Agent, or Firm*—Webb Ziesenheim Logsdon Orkin & Hanson, P.C.

[57] ABSTRACT

A method is disclosed for inserting a tendon (52) into a bore (4) for the purpose of reinforcing rock (6) in which the bore (4) has been drilled. The method enables the tendon (52) to be inserted into the bore while being rotated at the same time to facilitate the mixing of anchoring material (122) located in the bore (4). Apparatus for carrying out the method is also provided.

27 Claims, 5 Drawing Sheets

METHOD FOR REINFORCING ROCK WITH A TENDON

The present invention relates to a method of reinforcing rock with a tendon. More particularly, a way of inserting the tendon into the rock is disclosed. The method has practical applications beyond mines and extends to civil, structural and mechanical engineering areas. Also disclosed herein is apparatus for use in the method.

BACKGROUND OF THE INVENTION

The reinforcement of rock originally involved the use of passive support systems that utilised timber and steel structural supports. Active support systems were subsequently developed including the provision of relatively rigid roof bolts which have been widely used and still find application. Early roof bolts were provided with mechanically operated wedge devices to facilitate anchorage of the roof bolts in the relevant rock. Later, concrete grout and chemical anchoring materials were developed for anchorage of roof bolts. Most recently, flexible wire tendons with a length of between six to twelve meters and which are commonly used with such anchoring materials have found widespread application.

To install such a wire tendon, the bore for receipt of the tendon is first drilled into the rock to be supported. Given the length of the tendon it is common to use a number of drill rod extensions to obtain the required bore depth. The selected anchoring material is then inserted in the bore and the wire tendon manually or mechanically driven into the bore prior to being tensioned to thereby support the rock once it has been anchored in position by the anchoring material.

The anchoring material is typically contained in cartridges which facilitates its insertion into the drilled bore. The material exists in the cartridges as separate adhesive and catalyst components which are mixed together by the tendon when inserted in the bore to cause the anchoring material to set and so anchor the tendon in position.

To date, however, the amount of anchoring material used has been limited such that only up to about three meters of tendon length is encapsulated by the material resulting in less than optimal anchorage of the tendon and support of the rock.

The encapsulation length of the tendons has been restricted due to the inability to drive a tendon into long lengths of highly viscous cartridges while at the same time rotating the tendon to mix the anchoring material the cartridges contain.

More particularly, while portable pneumatic bolters are available for rotating a wire tendon while driving it into a predrilled bore in the roof of a mine for example, use of such machines involves exerting the drive and rotational forces on the trailing end of the tendon. When a substantial length of the tendon protrudes from the bore and is unable to be readily inserted further as in the case where the bore is filled with several meters of cartridges containing anchoring material, the application of the drive force to the trailing end of the tendon causes the tendon to flex while being rotated which is highly undesirable as it presents a safety risk to the user of the apparatus and anyone in the immediate vicinity of the apparatus.

Machines with adjacent rotating thrust wheels adapted to grip a flexible tendon between them and so drive the tendon into a predrilled bore are also known. However, such apparatus do not have the capacity to rotate the tendon while driving it into the bore as is required when anchoring material comprising separate adhesive and catalyst components is to be used. Moreover, the grip provided by the apparatus is inadequate to readily thrust the tendon through long lengths of adhesive material containing cartridges.

Drilling rigs for drilling bores to a desired depth using a plurality of drill extension rods are also known. However, there remains a need for a method enabling greater encapsulation of long flexible tendons with anchoring material than has been achieved in the past in order to enhance the reinforcement of rock.

SUMMARY OF THE INVENTION

It is an aim of the present invention to ameliorate at least one of the drawbacks of the prior art.

In a first aspect of the invention there is provided a method for reinforcing rock with a tendon, comprising the steps of:

(a) gripping the tendon with a gripping means that is rotatable by a motor;

(b) rotating the gripping means with the motor such that the tendon is caused to rotate about its longitudinal axis;

(c) driving one end region of the tendon along a bore extending into the rock while the tendon as being rotated;

(d) halting the rotation of the tendon and releasing the grip of the gripping means;

(e) withdrawing the gripping means toward an opposite end of the tendon; and (f) repeating the above steps as required to insert the tendon in the bore; and wherein the tendon is subsequently tensioned after anchored in position by anchoring material located in the bore through which material the one end region of the tendon has been driven.

Generally, some of the anchoring material will have a faster setting time compared to the remainder of the anchoring material so that the one and end region of the tendon is anchored in the bore by the faster setting anchoring material before the tendon is tensioned. The tensioning will usually be carried out prior to the setting of the remainder of the anchoring material.

Accordingly, in a second aspect of the invention there is provided a method for reinforcing rock with a tendon, comprising the steps of:

(a) drilling a blind bore into the rock;

(b) inserting one after the other along the bore a number of lots of anchoring material for anchoring the tendon in the bore once set; and (c) driving one end of the tendon into the bore and through the anchoring material to thereby locate the tendon along the bore, wherein said driving of the tendon involves:

(i) gripping the tendon with gripping means rotatable by a motor;

(ii) rotating the gripping means using the motor such that the tendon is caused to rotate about its longitudinal axis; and (iii) pushing the tendon into the bore while the tendon is being rotated;

(iv) halting the rotation of the tendon and releasing the grip of the gripping means;

(v) withdrawing the gripping means toward an opposite end of the tendon; and (vi) repeating steps (i) to (v) as necessary to locate the tendon along the bore; and wherein one of the lots of the anchoring material has a faster setting time compared to the remainder of the anchoring material, and the one end of the tendon is anchored in the bore by the faster setting said anchoring material before the tendon is tensioned, and wherein the tensioning is carried out prior to the setting of the remainder of the anchoring material.

Preferably, the anchoring material will initially be contained in a plurality of cartridges in the form of separate adhesive and catalyst components which are mixed by the rotation of the tendon during its insertion into the bore. The mixing causes the anchoring material to set and thereby anchor the tendon.

Usually, sufficient anchoring material will be placed in the bore to encapsulate and anchor the tendon substantially along the entire length of the tendon that has been inserted into the bore.

The method of the invention enhances the thrust with which a tendon is able to be driven into a bore, leading to enhance efficiency of the installation operation. The method also enables flexible tendons to be driven through greater lengths of anchoring material while the tendon is rotated at the same. This results in improved encapsulation of the tendon and thereby, improved reinforcement of the rock. Moreover, the rock is able to be tensioned prior to anchorage of a substantial length of the tendon to the rock.

Apparatus is also provided for use in the method of the invention. Accordingly, in a third aspect there is provided an apparatus for the installation of a tendon into a bore, comprising:

gripping means having a through passageway for receipt of the tendon, and being adapted to be able to grip the tendon when received in the through passageway;

a guide;

drive means for driving the gripping means along the guide in one direction to thereby drive the tendon into the bore when gripped by the gripping means, and for withdrawing the gripping means in an opposite direction to allow the tendon to pass through the through passageway of the gripping means when the grip on the tendon by the gripping means is released; and rotation means for rotating the gripping means and thereby the tendon when the gripping means is driven along the guide in the one direction by the drive means.

In a fourth aspect of the invention there is provided an adaptor for attachment to a drill rod, comprising:

an adaptor body able to be attached to an end of the drill rod;

a shank engaged with the adaptor body to thereby form a shaft;

a housing receiving the shaft such that an annular space is defined between the housing and the shaft, the housing having a fluid supply passageway for the supply of fluid to the annular space from the exterior of the assembly; and seal means sealing the annular space defined in the housing;

wherein the shaft is rotatable with respect to the housing, and channel means are formed in the shaft for passage of the fluid from the annular space to the drill rod when attached to the adaptor.

The provision of the adaptor enables apparatus used for installation of the tendon to also be used to drill the bore into the rock. This allows the installation of the tendon to be carried out in a single pass operation. That is, the bore can be drilled followed immediately by the installation of the tendon into the bore without the need for different equipment to carry out the two procedures which leads to savings in costs.

The present invention will now hereinafter be described with reference to a number of preferred embodiments with reference to the accompanying drawings.

BRIEF DESCRIPTION OF THE ACCOMPANYING DRAWINGS

BEST MODE OF CARRYING OUT THE INVENTION

Figure 1:
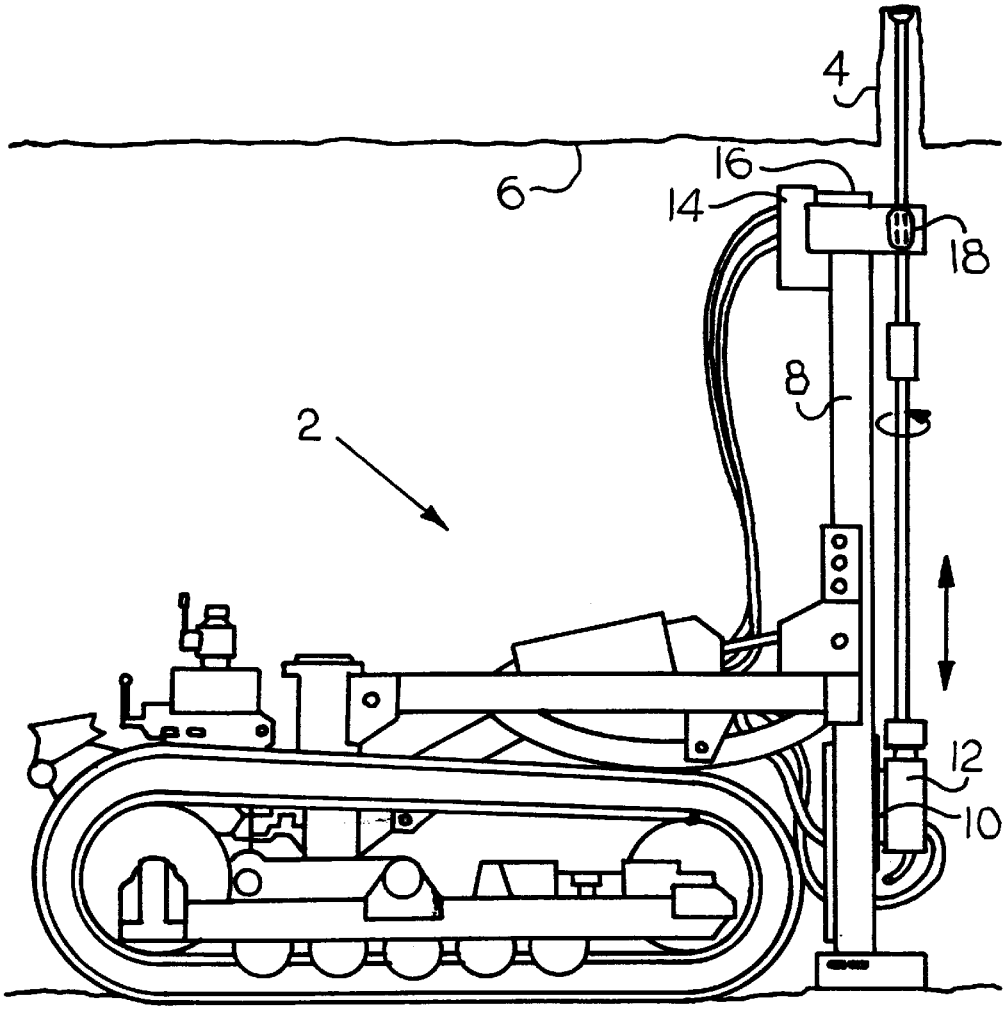
FIG. 1 illustrates the drilling of a bore into rock using a drilling rig.

A drilling rig 2 adapted to be able to drill a bore 4 in rock forming the roof 6 of a mine and to subsequently install a flexible tendon into the bore is illustrated in FIG. 1.

The drilling rig, is provided with a slide 8 on which is slidably mounted a carriage 10 carrying a drive motor 12. A feed motor 14 mounted on an end 16 of the slide is coupled to carriage 10 to move the carriage and thereby the drive motor 12 along the slide 8 as required. A clamp device 18 is also mounted on the slide adjacent to the feed motor for the purpose of guiding or holding a drill rod or flexible tendon against movement as the case may be.

Figure 2:
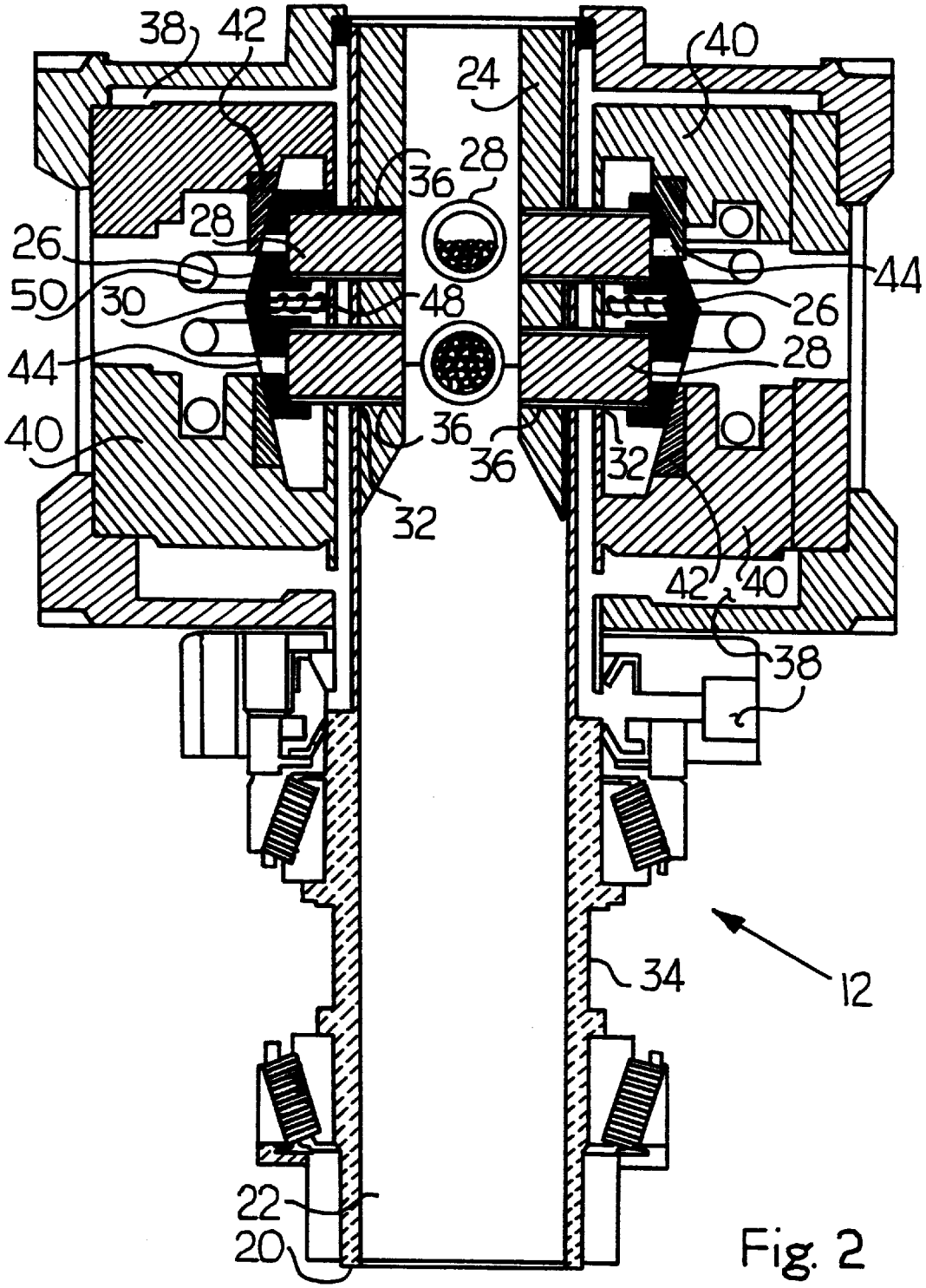
FIG. 2 is a longitudinal cross-sectional view of the motor of the drilling rig of FIG. 1 showing gripping means for gripping a tendon.

A longitudinal or cross-sectional view of drive motor 12 is shown in FIG. 2. The drive motor comprises an elongate spindle 20 defining a passageway 22 extending through the motor to enable a flexible tendon to be inserted into the motor and be gripped by gripping means comprising sleeve insert 24 and jaws 26. Each jaw 26 has a pair of jaw pins 28 secured to a jaw shoe 30. As can be seen from the figure, the jaw pins project through openings 32 defined at circumferential locations around the peripheral wall 34 of spindle 20 and protrude into corresponding through openings 36 defined in sleeve insert 24.

Figure 3:
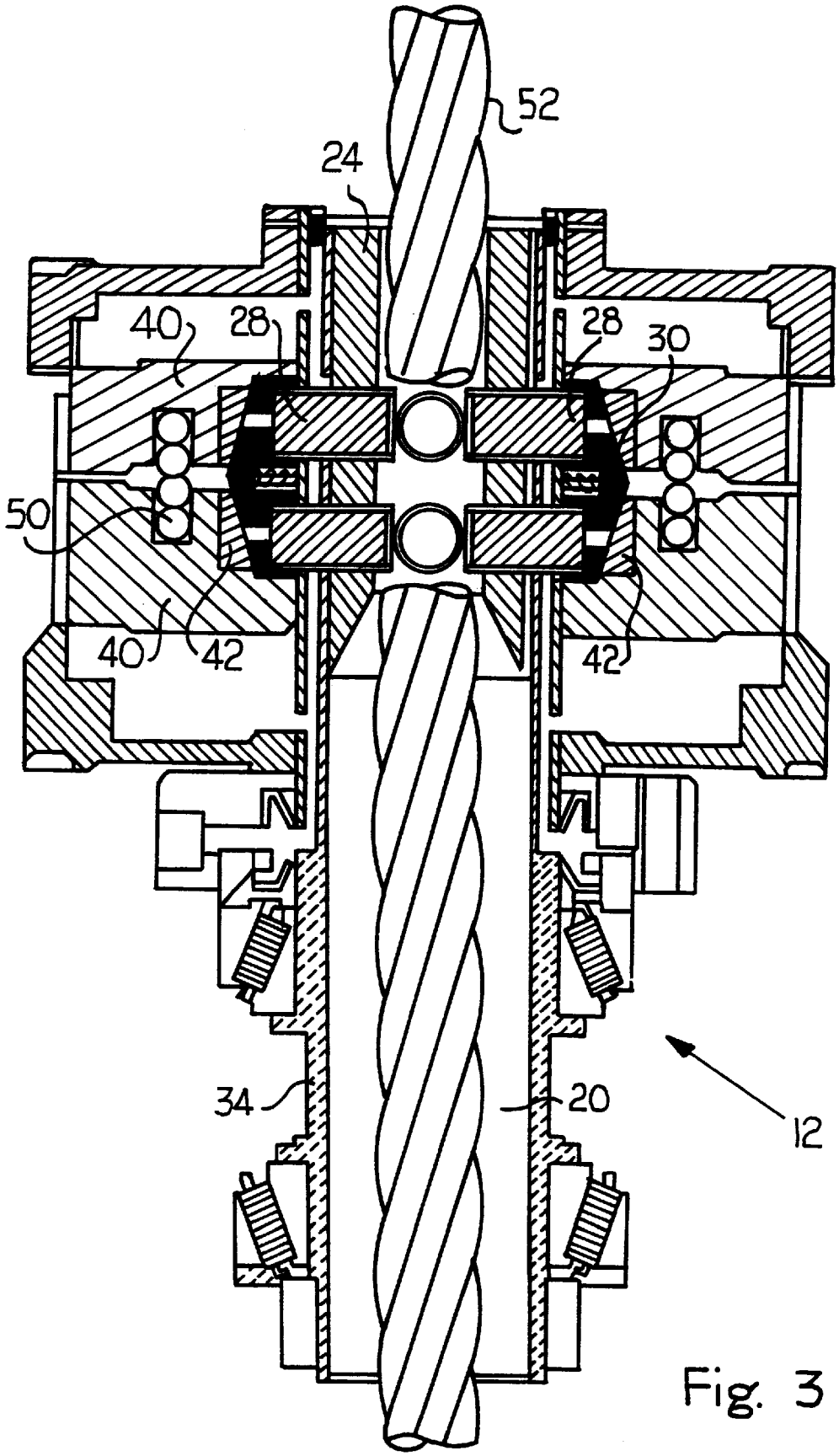
FIG. 3 is a longitudinal cross-sectional view illustrating the gripping means shown in FIG. 4 when operated.

To operate the jaws 26, air is fed under pressure through air paths 38 to force pistons 40 associated with each respective jaw 26 toward each other as indicated in FIG. 3. The movement of pistons 40 causes drive sleeves 42 to press against inclined surfaces 44 of jaw shoes 30 to thereby force jaw pins 28 into a gripping position within passageway 46 of the sleeve insert 24 against the action of springs 48.

Retraction of jaw pins 28 from the gripping position is achieved by decreasing the pressure acting on pistons 40 to allow the pistons to withdraw under the action of helical spring 50 to enable jaw shoes 30 to be returned to their resting position by springs 48 as will be readily appreciated.

The diameter of passageway 46 of sleeve insert 24 is selected to facilitate the guiding of a flexible tendon and to ensure that the tendon is gripped centrally within the sleeve by jaws pins 28.

The provision of sleeve insert 24 in through passageway 22 of spindle 20 together with suitably adapted jaw pins 28 enables tendon 52 to be dripped and rotated while at the same time allowing the tendon to pass through spindle 20 during installation of the tendon using rig 2.

In order to drill bore 4 into the rock of mine roof 6, the shank of an adaptor is inserted in passageway 46 of sleeve insert 24 and gripper by jaws 26.

Figure 4:
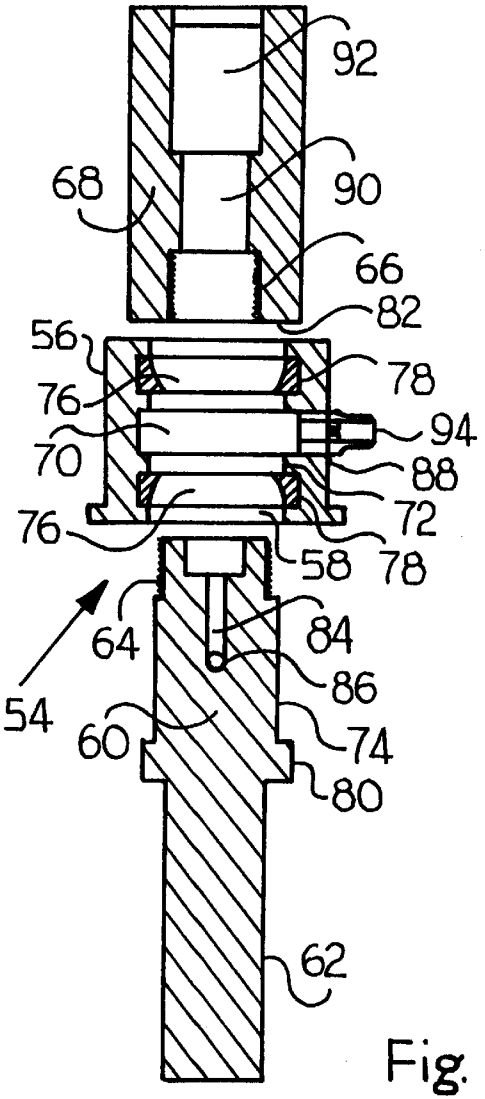
FIG. 4 is an exploded longitudinal cross-sectional view of an adaptor for attachment to a drill rod and which is able to be received and held in the gripping means shown in FIGS. 2 and 3.

One form of adaptor for this purpose will now be described with reference to FIG. 4. The adaptor 54 comprises a water housing 56 with a through bore 58 dimensioned to receive an upper portion 60 of a shank 62 therein. The shank 62 has a thread 64 engageable with a corresponding thread 66 defined in an adaptor body 68.

When upper portion 6 of shank 62 is received within the through bore 58 of the water housing, an annular space 70 is defined between inner wall 72 of the housing and outer peripheral surface 74 of the shank.

The annular space is sealed by sealing means in the form of a pair of seals 76 respectively received in grooves 78 defined in the inner wall 72 of the water housing. The seals bear against the peripheral surface 74 of shank 62 to thereby seal the annular space 70.

When adaptor 54 is assembled, the water housing is rotatable with respect to the shaft formed by shank 62 and adaptor body 68. The housing is, however, restricted against movement along the adaptor by virtue of flanges 80 on shank 62 and abutment surface 82 of the adaptor body. Channel 84 defined ; the upper portion of shank 62 opens into through channel 86 allowing water entering the annular space through water supply passageway 88 in use to pass into bore 90 of the adaptor body and subsequently to recess 92. Recess 92 is formed to receive and fixedly hold the shaft of a threaded insert (not shown) adapted to engage with a coupling end of a drill rod to thereby secure the adaptor 54 and the drill rod together. A further through passageway is defined in the threaded insert to enable passage of the water into the rear of the drill rod from where the water is ultimately released into the particular bore being drilled for flushing purposes as is conventionally known.

In use, the water housing 56 is inhibited from rotating by a water supply conduit attached to nipple 94.

Figure 5:
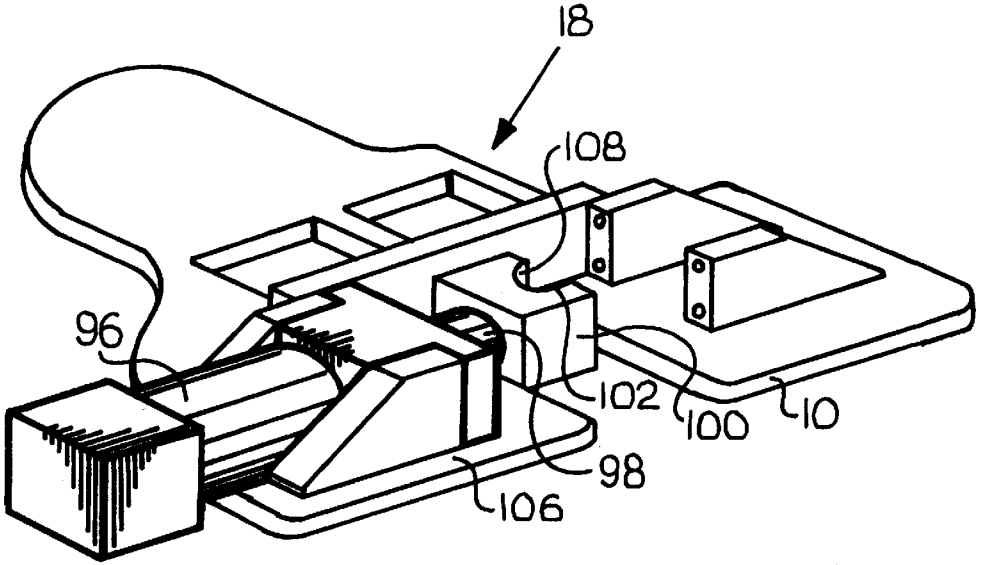
FIG. 5 is a perspective view of a clamping device of the drilling rig shown in FIG. 1.

The clamp device 18 of drill rig 2 is more clearly shown in FIG. 5. The clamp device comprises a conventional hydraulic cylinder 96 adapted to drive and retract a ram 98 carrying clamp jaw 100. In use, a drill rod or tendon is guided between recess 102 of clamp jaw 100 and the edge 104 of plate 106 of the clamp device. When it is desired to clamp the drill rod or tendon, the hydraulic cylinder 96 is operated to force the drill rod or tendon against edge 104 with the clamp jaw and so prevent withdrawal from recess 102. To further assist in gripping the tendon or drill rod, a plurality of tungsten steel studs 108 are provided on the face of recess 102.

Figures 6A, 6B, 6C, 6D:
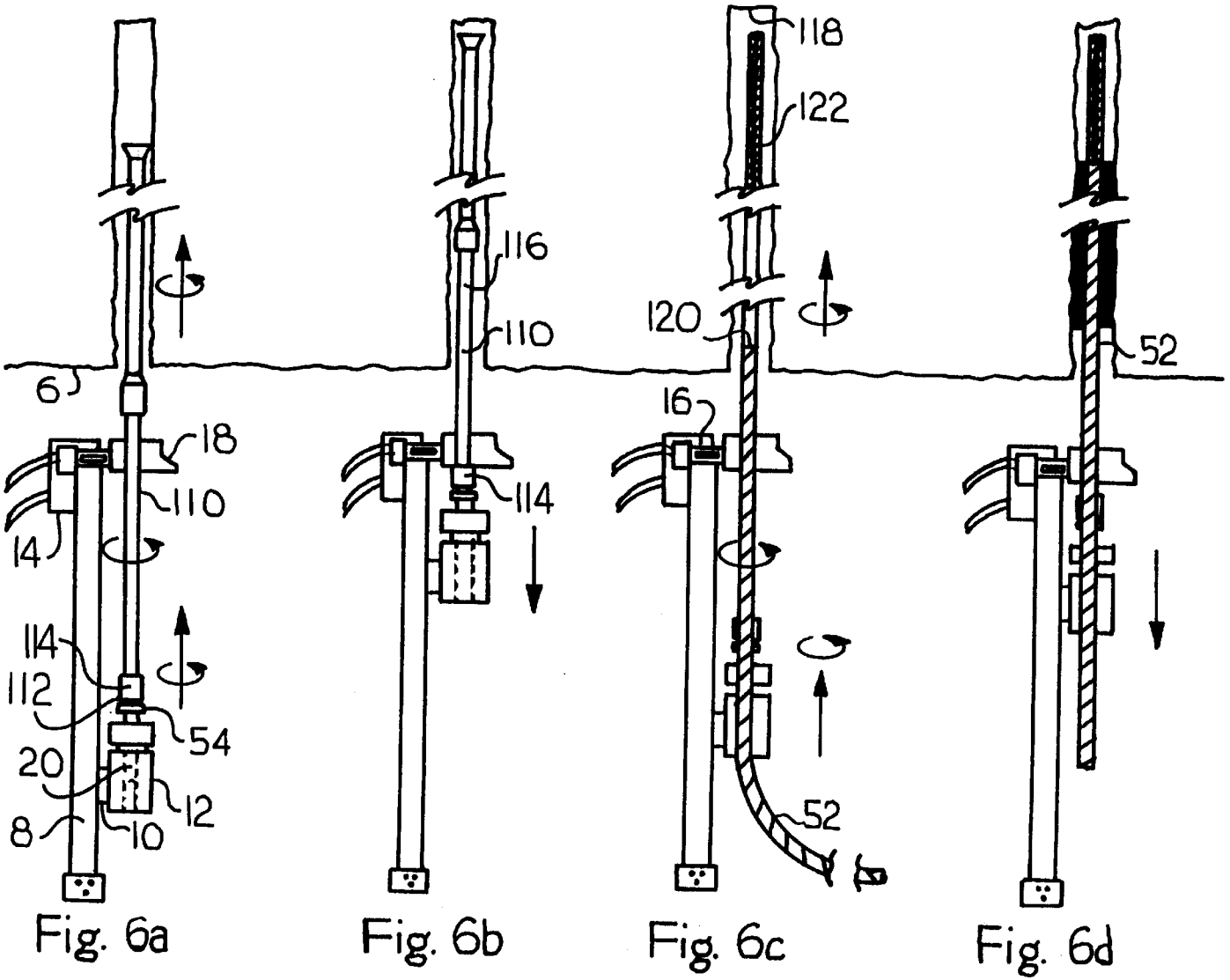
FIGS. 6(*a*) to (*d*) illustrates the installation of a wire tendon into rock using the drilling rig of FIG. 1.

The installation of a tendon in the form of a flexible multi-strand wire cable to reinforce the rock of the mine roof 6 is illustrated in FIGS. 6(*a*) to (*d*). The method utilises drilling rig 2 shown in FIG. 1 but for clarity reasons the bulk of the rig is not shown.

As can be seen in FIG. 6(*a*), adaptor 54 is attached to lower drill rod 110 through threaded insert 112, and its shank 62 is in turn gripped by jaws 26 so that the drill rod is rotated by drive motor 12 as the drive motor is drawn up slide 8 by feed motor 14 to thereby drill the bore into the rock. The ram 98 of clamp device 18 remains in a resting position during this time to facilitate :he guiding of the drill rod.

Once drive motor 12 has travelled along slide 8, the rotation of the drive motor is halted and the ram 98 of clamp device 18 is operated to clamp female coupling end 114 of drill rod 110 as indicated in FIG. 6(*b*).

The drive motor 12 is then operated in reverse rotation to release the threaded insert 112 from coupling end 114 of drill rod 110, and the feed motor is operated to withdraw drive motor 12 down slide 2 to enable mare threaded end 116 of a further drill rod to be mated with coupling end 114 of drill rod 110 clamped by the clamping device. The further drill rod is subsequently mated with the threaded insert 112 is held by adaptor 54 the shank of which remains held by jaw 26 while the further drill rod is located in position.

In order to continue the drilling of bore 18, the grip on coupling end 114 of the drill rod by clamp device 18 is released and the drive motor is again operated while being drawn up slide 8 by feed motor 14. These steps are repeated as necessary using additional drill rods to achieve the desired depth of bore 4.

When the drilling of bore 4 has been completed, the drill rods are removed together with the adaptor after being released from jaws 26.

Following drilling of bore 4, a number of cartridges each containing anchoring material comprising separate catalyst and adhesive components are inserted into the bore for the purpose of anchoring tendon 52 to the mine rock.

The anchoring material in the cartridges is caused to set after being mixed by the tendon as it is inserted into the bore. The setting time for the first cartridge located immediately adjacent to blind end 118 of the bore is faster than that of the other cartridges used. Typically, the setting time of the anchoring material contained in the first cartridge is about 60 seconds after the catalyst and adhesive components of that cartridge are mixed together by the tendon. The setting time of the remaining cartridges will generally be about 5 minutes following mixing.

To insert tendon 52 in bore 4, the tendon is firstly fed into the rear of passageway 22 of spindle 20 of drive motor 12 and up to clamp device 18 through insert 24 of the gripping means. The jaws 30 of the gripping means are subsequently operated and the tendon rotated by drive motor 12 while the ram 98 of clamp device is in a resting position and the drive motor is drawn up slide 8 as a result of the operation of feed motor 14. The travel of the drive motor along the slide causes end 120 of the tendon to be thrust along bore 4 and through the anchoring material contained in cartridges 122. At the end of the travel along slide 8, the rotation of drive motor 12 is halted and ram 98 is operated by hydraulic cylinder 96 to clamp and so hold the tendon while drive motor 12 is withdrawn down the slide by the feed motor 8 after the tendon is released from jaws 26. Once the drive motor has been returned to the base of slide 8, jaws 26 are again operated to grip the tendon prior to release of the grip on the tendon by clamp device 18. The above steps are then repeated as necessary to insert the tendon along the entire length of the bore.

Once the tendon has been inserted and its end 120 anchored to the rock following setting of the anchoring material adjacent to the blind end of the bore, the tendon is tensioned by screwing a nut onto the threaded end of the tendon protruding from the bore (not shown) to thereby press a collar against the surface of the mine roof as is commonly known. The tensioning is carried out prior to the tendon being anchored to the rock by the slower setting anchoring material present within the bore.

If desired, sufficient anchoring material can be placed within the bore to provide substantially complete encapsulation of the tendon thereby enabling anchorage of the tendon along its length to the rock.

Although the present invention has been described hereinbefore with reference to several embodiments, numerous variations and modifications are possible without departing from the scope of the invention which is defined in the following claims.

We claim:

1. A method for reinforcing rock with a tendon, comprising the steps of:

(a) gripping the tendon with a gripping means that is rotatable by a motor;

(b) rotating the gripping means with the motor such that the tendon is caused to rotate about its longitudinal axis;

(c) driving one end region of the tendon along a bore extending into the rock while the tendon is being rotated;

(d) halting the rotation of the tendon and releasing the grip of the gripping means;

(e) withdrawing the gripping means toward an opposite end of the tendon; and (f) repeating the above steps as required to insert the tendon in the bore; and wherein the tendon is subsequently tensioned after anchored in position by anchoring material located in the bore through which material the one end region of the tendon has been driven.

2. A method according to claim 1 further comprising:

holding the tendon against withdrawal from the bore after halting rotation of the tendon in step (d) and prior to withdrawing the gripping means toward the opposite end of the tendon in step (e); and releasing the hold on the tendon prior to repeating step (b).

3. A method according to claim 1 wherein a passageway is formed through the motor and the method further comprises the steps of:

feeding the tendon through the passageway to the gripping means prior to commencing the insertion of the tendon in the bore; and wherein the tendon passes through the passageway during the withdrawal of the gripping means toward the opposite end region of the tendon in step (e).

4. A method according to claim 1 wherein the gripping means comprises a sleeve with a plurality of openings through which extend jaw means moveable between first and second positions, and wherein the jaw means are caused to grip the tendon when moved from the first position to a second position and to release the tendon when moved in the opposite direction.

5. A method according to claim 4 wherein the sleeve is received by a spindle of the motor that defines the passageway, and the sleeve is caused to rotate by rotation of the spindle.

6. A method according to claim 4 further comprising drilling the bore for receipt of the tendon before feeding the tendon through the passageway to the griping means, comprising the steps of:

(i) inserting an adaptor into the gripping means and causing the gripping means to grip the adaptor;

(ii) securing a drill rod to the adaptor;

(iii) using the drill rod to drill the bore; and (iv) releasing the drill rod from the adaptor.

7. A method according to claim 6 further comprising repeating steps (ii) to (iv) using one or more further drill rods one after the other to extend the bore to a desired depth.

8. A method according to claim 1, wherein the one end region of the tendon is driven into the bore by moving the motor along a guide toward the bore, and the gripping means is withdrawn toward the opposite end region of the tendon by returning the motor along the guide.

9. A method according to claim 1 further comprising:

placing sufficient said anchoring material in the bore to encapsulate and anchor the tendon substantially along the entire length of the tendon inserted in the bore, once the adhesive material has set.

10. A method according to claim 9 wherein the anchoring medium is contained in a plurality of cartridges and is mixed by the rotation of the tendon during the insertion of the tendon into the bore, and wherein the mixing causes the anchoring material to set and thereby anchor the tendon in position in the bore.

11. A method according to claim 9 wherein the one end region of the tendon is anchored in position by the anchoring material before the tendon is tensioned, and wherein the tensioning is carried out prior to the setting of remaining said anchoring material encapsulating the rest of the tendon in the bore.

12. A method for reinforcing rock with a tendon, comprising the steps of:

a) drilling a blind bore into the rock;

b) inserting one after the other along the bore a number of lots of anchoring material for anchoring the tendon in the bore once set; and (c) driving one end of the tendon into the bore and through the anchoring material to thereby locate the tendon along the bore, wherein said driving of the tendon involves:

(i) gripping the tendon with gripping means rotatable by a motor;

(ii) rotating the gripping means using the motor such that the tendon is caused to rotate about its longitudinal axis; and (iii) pushing the tendon into the bore while the tendon is being rotated;

(iv) halting the rotation of the tendon and releasing the grip of the gripping means;

(v) withdrawing the gripping means toward an opposite end of the tendon; and (vi) repeating steps (i) to (v) as necessary to locate the tendon along the bore; and wherein one of the lots of the anchoring material has a faster setting time compared to the remainder of the anchoring material, and the one end of the tendon is anchored in the bore by the faster setting said anchoring material before the tendon is tensioned, and wherein the tensioning is carried out prior to the setting of the remainder of the anchoring material.

13. A method according to claim 12 wherein the rotation of the tendon mixes the anchoring material and thereby causes the anchoring material to set.

14. A method according to claim 12, wherein the number of lots of anchoring material are contained in a plurality of cartridges when inserted into the bore.

15. A method according to claim 12 further comprising:

holding the tendon against withdrawal from the bore after halting rotation of the tendon in step (iv) and prior to withdrawing the gripping means toward the opposite end of the tendon in step (v); and releasing the hold on the tendon prior to repeating step (ii).

16. A method according to claim 12 wherein a passageway is formed through the motor and the method further comprises:

feeding the tendon through the passageway to the gripping means prior to commencing said driving of the one end of the tendon into the bore; and wherein the tendon passes through the passageway during the withdrawal of the gripping means toward the opposite end of the tendon in step (v).

17. A method according to claim 12 wherein the gripping means comprises a sleeve with a plurality of openings through which extend jaw means moveable between first and second positions, and wherein the jaw means are caused to grip the tendon when moved from the first position to a second position and to release the tendon when moved in the opposite direction.

18. A method according to claim 17 wherein the sleeve is received by a spindle of the motor that defines the passageway, and the sleeve is caused to rotate by rotation of the spindle.

19. A method according to claim 12 wherein the drilling in step (a) comprises the steps of:

(1) inserting an adaptor into the gripping means and causing the gripping means to grip the adaptor; and (2) securing a drill rod to the adaptor;

(3) using the drill rod to drill the bore; and (4) releasing the drill rod from the adaptor.

20. A method according to claim 19 further comprising repeating step (2) to (4) using one or more further drill rods one after the other to extend the bore to a desired depth.

21. A method according to claim 12 wherein the one end of the tendon is driven into the bore by moving the motor along a guide toward the bore, and the gripping means is withdrawn toward the opposite end region of the tendon by returning the motor along the guide.

22. Apparatus for the installation of a tendon into a bore, comprising:

gripping means having a through passageway for receipt of the tendon, and being adapted to be able to grip the tendon when received in the through passageway;

a guide;

drive means for driving the gripping means along the guide in one direction to thereby drive the tendon into the bore when gripped by the gripping means, and for withdrawing the gripping means in an opposite direction to allow the tendon to pass through the through passageway of the gripping means when the grip on the tendon by the gripping means is released; and rotation means for rotating the gripping means and thereby the tendon when the gripping means is driven along the guide in the one direction by the drive means.

23. Apparatus according to claim 22 further comprising clamp means adapted to inhibit withdrawal of the tendon from the bore while the gripping means is being withdrawn in the opposite direction by the drive means.

24. Apparatus according to claim 22 wherein the rotation means is located on a carriage mounted on the guide and the gripping means is carried by the rotation means, and wherein the griping means is caused to be driven along the guide in the one direction and the opposite direction by movement of the carriage by the drive means.

25. Apparatus according to claim 22 wherein the rotation means also has a through passageway for receipt of the tendon, and wherein the through passageway of the rotation means and the through passageway of the gripping means are substantially coaxial.

26. Apparatus according to claim 22 wherein the rotation means comprises one motor and the drive means comprises another motor.

27. Apparatus according to claim 22 wherein the guide is orientated substantially vertically.

* * * * *